US006799434B1

(12) United States Patent
Hobbs, Jr.

(10) Patent No.: US 6,799,434 B1
(45) Date of Patent: Oct. 5, 2004

(54) PORTABLE COOLER

(76) Inventor: Edgar Hobbs, Jr., 71 Charter Cir. Apt. 6N, Ossining, NY (US) 10562

( * ) Notice: Subject to any disclaimer, the term of this patent is extended or adjusted under 35 U.S.C. 154(b) by 0 days.

(21) Appl. No.: 10/734,826

(22) Filed: Dec. 12, 2003

(51) Int. Cl.[7] ..... F25B 21/00

(52) U.S. Cl. ..... 62/457.9; 62/371; 62/457.1; 62/530

(58) Field of Search ..... 62/371, 457.1, 62/457.2, 457.7, 530, 457.9

(56) References Cited

U.S. PATENT DOCUMENTS 4,297,850 A * 11/1981 Reed ..... 62/3.6
4,571,740 A * 2/1986 Kirby et al. ..... 455/344
6,253,570 B1 * 7/2001 Lustig ..... 62/457.2
6,354,104 B1 * 3/2002 Feagin ..... 62/457.1

* cited by examiner

*Primary Examiner*—Melvin Jones
(74) *Attorney, Agent, or Firm*—Goldstein Law Offices, P.C.

(57) ABSTRACT

A portable cooler for selectively maintaining a variety of food and beverage items at a low temperature, comprising a substantially rectangular insulated container and a cooling device for cooling the interior volume of the insulated container. The insulated container has a storage compartment, a lid, and at least one hinge which pivotally attaches the lid to the storage compartment. The cooling device has an associated air outlet vent for exhausting heat extracted from the interior volume of the insulated container during operation of the cooling device. The portable cooler has a display panel for enabling a user to control the operation of the cooling device and has a battery compartment for selective containment therein of at least one battery for powering the cooling device.

8 Claims, 2 Drawing Sheets

PORTABLE COOLER

BACKGROUND OF THE INVENTION

1. Field of the Invention

The invention generally relates to a portable cooler, and in particular relates to a battery operated portable cooler which may be easily carried by a user and which functions to cool various food and beverage items contained therein.

2. Description of the Related Art

Individuals traveling to and from locations may find it desirable or even necessary to maintain a variety of food and beverage items at a low temperature while in transit. Additionally, while engaged in an outdoor activity such as picnicking, an individual will often need to have cold beverages or food available because certain beverages and foods taste better when cold, and additionally may need to keep food and beverage items cold in order to prevent said items from spoiling. Accordingly, there is a need for a portable cooler which is capable of maintaining foods and beverages at a low temperature so that they are more appetizing and also so that they do not spoil.

A variety of portable coolers have been devised to answer these needs. An interesting example is provided by U.S. Pat. No. 6,253,570 to Lustig, which appears to show a portable cooler for carrying temperature sensitive medications such as insulin, having a temperature-sensing element and a display, for monitoring and displaying, respectively, the internal temperature of an insulated container. Furthermore, U.S. Pat. No. 6,173,582 to Hixson appears to show a portable cooler for cans of beverages, having an insulated container having an inclined channel which connects a filling means to a dispensing means, and further having a preferably non-thermoelectric cooling means such as a "cold pack" filled with a chillable material positioned within the insulated container. Moreover, U.S. Pat. No. 5,235,822 to Leonovich, Jr. appears to show a portable cooler in combination with an audio system mounted in a recessed cavity on a wall of an insulated container.

While these devices may be suitable for the particular purpose employed, or for general use, they would not be as suitable for the purposes of the present invention as disclosed hereinafter.

SUMMARY OF THE INVENTION

It is an object of the invention to provide a portable cooler which may be easily transported between locations, and which is not unduly large or heavy. Accordingly, the portable cooler described is small and lightweight, and may be easily transported between locations by the average adult.

It is another object of the invention to provide a portable cooler having means for maintaining the interior of the portable cooler at a constant temperature. Accordingly, a user is able to set a temperature at which the cooling device is activated. When the interior temperature is higher than the set temperature, the cooling device is activated to cool the interior, and remains activated until the temperature lowers to the set temperature, thereby providing a portable cooler having means for maintaining the interior of the portable cooler at a constant temperature.

It is yet another object of the invention to provide a portable cooler wherein the interior temperature of the portable cooler is readily determinable by a user. Accordingly, the portable cooler has a temperature display which selectively visually indicates the interior temperature of the portable cooler.

It is an additional object of the invention to provide a portable cooler which is not unduly expensive. Accordingly, the materials from which the portable cooler is constructed are readily available, and its cost is not prohibitive.

Further objects of the invention will become apparent in the detailed description of the invention which follows.

The invention is a portable cooler for selectively maintaining a variety of food and beverage items at a low temperature, comprising a substantially rectangular insulated container and a cooling device for cooling the interior volume of the insulated container. The insulated container has a storage compartment, a lid, and at least one hinge which pivotally attaches the lid to the storage compartment. The cooling device has an associated air outlet vent for exhausting heat extracted from the interior volume of the insulated container during operation of the cooling device. The portable cooler has a display panel for enabling a user to control the operation of the cooling device, and has a battery compartment for selective containment therein of at least one battery for powering the cooling device.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
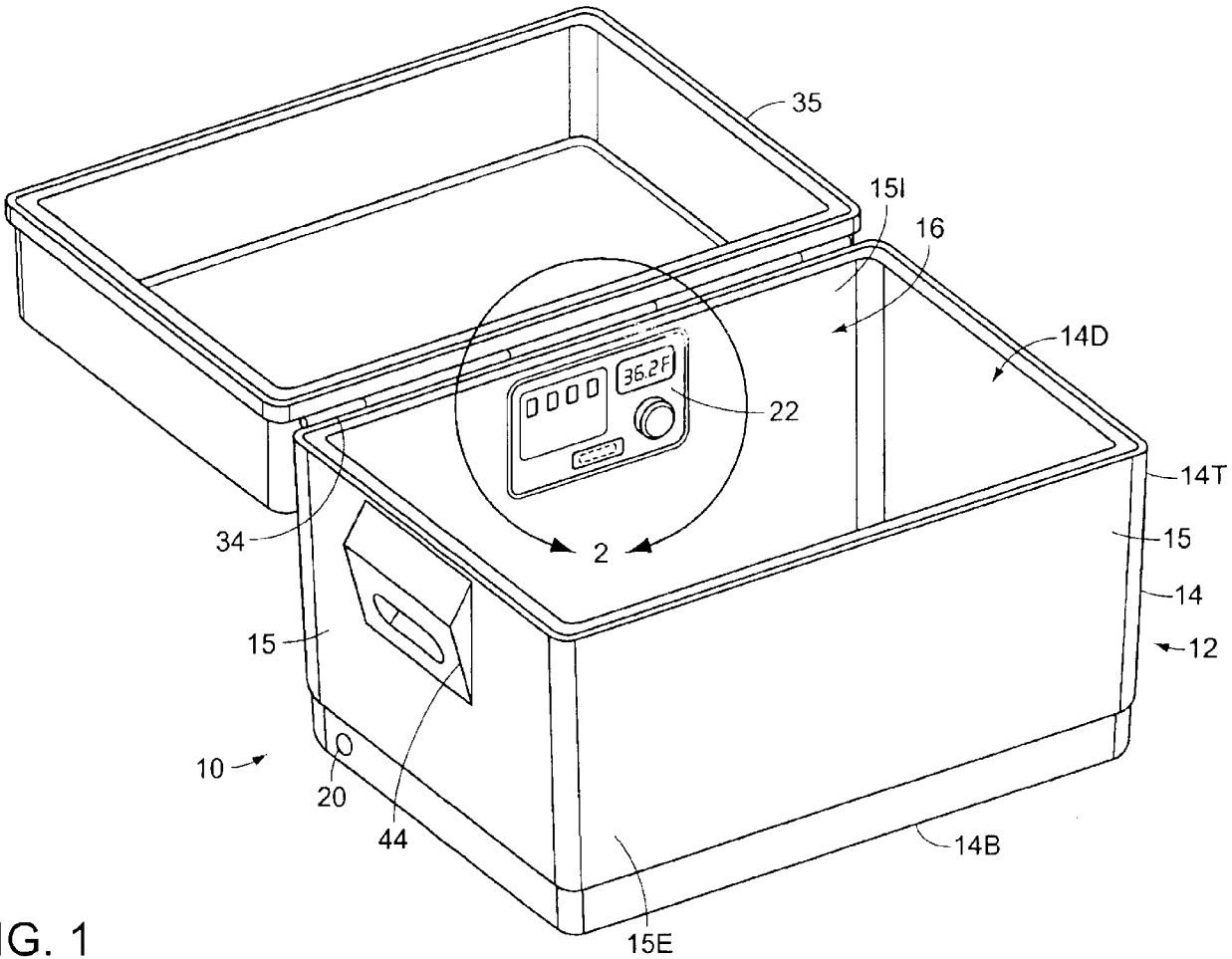
FIG. 1 is a perspective view of a portable cooler wherein an insulated container is in an open position.
Figure 2:
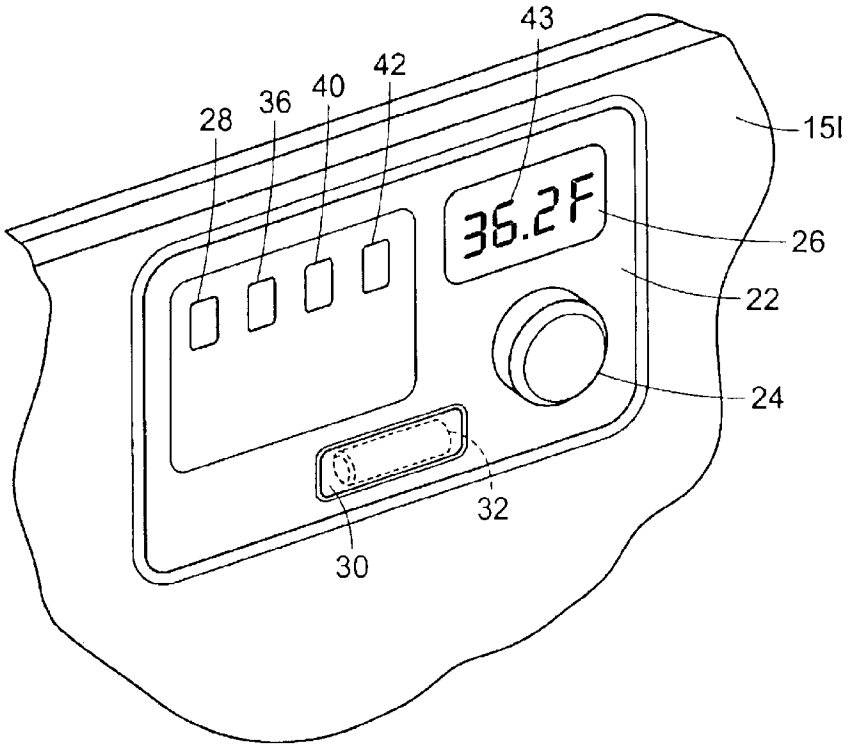
FIG. 2 is an enlarged perspective view taken generally in the area of circle 2 in FIG. 1, illustrating a display panel of the portable cooler.

FIG. 1 illustrates a portable cooler 10, for selectively maintaining food and beverage items at a low temperature, comprising a substantially hollow and rectangular insulated container 12 having an interior volume, and an associated cooling device 16 for cooling the interior volume. The insulated container 12 has a storage compartment 14, a lid 35, and at least one hinge 34 which pivotally attaches the lid 35 to the storage compartment 14. The storage compartment 14 has four walls 15, a bottom 14B, a top 14T, and a substantially rectangular opening 14D in proximity to the top 14T for selectively providing access to the items contained within the storage compartment 14. The four walls 15, the bottom 14B, and the lid 35, together define the interior volume off the portable cooler 10. Each of the walls 15 has an externally oriented surface 15E facing onto the exterior of the portable cooler 10, and an internally oriented surface 15I facing onto the interior volume of the portable cooler 10.

As illustrated, the insulated container 12 is substantially rectangular. It is additionally contemplated that the insulated container 12 may be provided in additional shapes. For example, a cylindrical insulated container 12 is contemplated, in which case, the insulated container 12 would have only one curved wall 15. The container 12 is insulated so that heat from the exterior of the container 12 will not easily enter into the interior volume of the insulated container 12. The insulation may be provided by sheets of foam or polyurethane material.

The insulated container 12 has an open position wherein the lid 35 has been swiveled away from the storage compartment 14 upon the at least one hinge 34, and a closed position wherein the lid 35 has been swiveled toward the storage compartment 14 upon the at least one hinge 34 in order that the opening 14D at the top 14T of the storage compartment 14 is sealed by the lid 35. The insulated container 12 is selectively opened in order to insert and remove items from the storage compartment 14.

The electric cooling device 16 is positioned within the storage compartment 14. Air within the interior of the insulated container 12 is selectively cooled by the cooling device 16. The cooling device 16 has an associated air outlet vent 20 extending through one of the walls 15 for exhausting the heat which is extracted from the interior volume of the insulated container 12 during operation of the cooling device 16. It is contemplated that the cooling device 16 will preferably be a freon-based refrigeration system.

The portable cooler 10 has a display panel 22 for enabling the user to control the operation of the cooling device 16. As illustrated, the display panel 22 is positioned upon an internally oriented surface 15I of one of the walls 15. It is contemplated that the display panel 22 may be positioned at alternate locations on the insulated container 12. The display panel 22 has an activation button 28 for selectively powering the cooling device 16, a thermistor for sensing the temperature within the interior volume of the insulated container 12, a temperature display 26 in electrical communication with the thermistor of the cooling device 16 for providing a visual numerical indication 43 of the temperature as sensed by the thermistor, and a temperature control knob 24, capable of rotating in two opposing directions, for varying the temperature at which the cooling device 16 is selectively activated. The temperature display 26 is preferably a liquid crystal display (LCD). The display panel 22 has a set temperature mode, an existing temperature mode, and a temperature display button 36 for toggling between the two modes. The set temperature is the temperature above which the cooling device 16 is selectively activated. While in the set temperature mode, the user is able to vary the set temperature by rotating the temperature control knob 24. Rotation of the temperature control knob 24 in a clockwise direction raises the temperature above which the cooling device 16 will be activated. Rotation of the temperature control knob 24 in a counterclockwise direction lowers the temperature above which the cooling device 16 will be activated. While in the existing temperature modes the user is able to view the temperature of the interior volume of the insulated container 12 upon the temperature display 26.

The display panel 22 is additionally provided with an "UP" button 40 and a "DOWN" button 42. The UP button 40 and the DOWN button 42 provide an alternate method for setting the temperature above which the cooling device 16 will be activated. In particular, to set the temperature above which the cooling device 16 will be activated by using the UP button 40 and the DOWN button 42, the user first presses the temperature display button 36 until the temperature is in the set temperature mode. The user then presses the UP button 40 to raise the set temperature, or alternately presses the DOWN button 42 to lower the set temperature.

The portable cooler 10 has a battery compartment 30 for selective containment therein of at least one battery 32 for selectively powering the cooling device 16. It is contemplated that the at least one battery 32 will be larger than the battery 32 illustrated in the drawing figures.

The externally oriented surfaces 15E of two of the four opposing walls 15 of the insulated container 12 have handles 44 attached thereunto, for enabling the user to easily transport the portable cooler 10 by carrying the portable cooler 10 by the handles 44. The portable cooler 10 is lightweight and small enough to be easily carried by an average adult.

In use, the portable cooler 10 is carried to and from locations by the handles 44 of the insulated container 12. The bottom 14B of the portable cooler 10 is placed upon a horizontal support structure. The user powers the cooling device 16 of the portable cooler 10 by depressing the activation button 28 located upon the display panel 22. The user sets the set temperature by pressing the temperature display button 36 until the temperature is in the set temperature mode, and then by rotating the temperature control knob 24. The user is able to readily determine the temperature of the interior volume of the insulated container 12 by pressing the temperature display button 36 until the display panel 22 is in the existing temperature mode. The heat which is extracted from the interior of the insulated container 12 during the cooling process is dissipated from the air outlet vent 20. The at least one battery 32 which selectively powers the cooling device 16 is removed from the battery compartment 30 and replaced with a new battery 32, as needed.

In conclusion, herein is presented a portable cooler having an electric cooling device for maintaining food and beverage items at a low temperature. The invention is illustrated by example in the drawing figures, and throughout the written description. It should be understood that numerous variations are possible, while adhering to the inventive concept. Such variations are contemplated as being a part of the present invention.

What is claimed is:

1. A portable cooler, for selectively maintaining a variety of food and beverage items at a low temperature, comprising:

an insulated container having a storage compartment, a lid, and at least one hinge which pivotally attaches the lid to the storage compartment, the storage compartment having at least one wall, a bottom, a top, and an opening in proximity to the top, said at least one wall, the bottom, and the lid together defining an interior volume off the portable cooler, each of said at least one wall having an externally oriented surface facing onto the exterior of the portable cooler, and an internally oriented surface facing onto the interior of the portable cooler, the insulated container having an open position wherein the lid has been swiveled upon the at least one hinge away from the storage compartment, and a closed position wherein the lid has been swiveled upon the at least one hinge toward the storage compartment in order to seal the opening at the top of the storage compartment;

a cooling device for cooling the interior volume of the insulated container, having an associated air outlet vent extending through one of the at least one walls for dissipating heat extracted from the interior volume of the insulated container during operation of the cooling device;

a display panel positioned upon the insulated container, for enabling the user to control the operation of the cooling device, having an activation button for selectively powering the cooling device, a thermistor for sensing the temperature within the interior volume of the insulated container, a temperature display in electrical communication with the thermistor of the cooling device for displaying the temperature as sensed by the thermistor, and a temperature control knob for varying the temperature at which the cooling device is selectively activated, said temperature control knob capable of rotating in two opposing directions; and a battery compartment for selective containment therein of at least one battery for selectively powering the cooling device.

2. The portable cooler as recited in claim 1, wherein the cooling device is positioned within the storage compartment of the insulated container.

3. The portable cooler as recited in claim 2, wherein the insulated container is substantially rectangular, having four walls, and a substantially rectangular opening in proximity to the top, wherein the four walls, the bottom, and the lid, together define the interior volume off the portable cooler, and wherein each of the walls has an externally oriented surface facing onto the exterior of the portable cooler, and an internally oriented surface facing onto the interior of the portable cooler.

4. The portable cooler as recited in claim 3, wherein the display panel is positioned upon an internally oriented surface of one of the walls.

5. The portable cooler as recited in claim 4, wherein the externally oriented surfaces of two opposing walls of the insulated container each have a handle attached thereunto, for enabling the user to easily transport the portable cooler between locations.

6. The portable cooler as recited in claim 5, wherein the temperature display is a liquid crystal display.

7. The portable cooler as recited in claim 6, wherein the cooling device is a freon-based refrigeration system.

8. A method of selectively maintaining a variety of food and beverage items at a low temperature, said method for use by an existing user, utilizing a portable cooler which is easily transported between locations, said portable cooler having an insulated container having a storage compartment and a lid pivotally attached to the storage compartment, said insulated container having an interior volume, said storage compartment having a bottom, said portable cooler further having a cooling device having an associated air outlet vent, said portable cooler further having a display panel having a set temperature mode, an existing temperature mode, and a temperature display button for toggling between the two modes, said display panel further having a temperature control knob having two opposing directions in which it may be rotated, said display panel further having a temperature display for providing a numerical indication of the temperature of the interior volume of the insulated container, said display panel further having an activation button, said portable cooler further having a battery compartment having at least one battery having a storage of energy, said insulated container having handles attached thereunto, said method for use in conjunction with an existing horizontal support structure, said method comprising the steps of;

carrying the portable cooler between locations by the handles of the insulated container;

supporting the bottom of the portable cooler on the horizontal support structure;

placing at least one of the items to be cooled within the interior volume of the insulated container;

closing the lid;

powering the cooling device by the at least one battery by depressing the activation button in order to cool the interior volume of the insulated container;

setting the temperature above which the cooling device is activated by pressing the temperature display button until the temperature is in the set temperature mode, and then by rotating the temperature control knob in one of two opposing directions;

determining the temperature of the interior volume of the insulated container by the user by pressing the temperature display button until the display panel is in the existing temperature mode, and by viewing the numerical indication of temperature upon the temperature display;

dissipating the heat extracted from the air during the cooling process from the air outlet vent;

opening the lid;

removing at least one of the items from the interior volume of the insulated container after it has been cooled; and replacing the at least one battery which selectively powers the cooling device with a new battery when the store of energy within the battery becomes substantially depleted.

* * * * *